United States Patent [19]

Restall et al.

[11] Patent Number: 4,698,130

[45] Date of Patent: Oct. 6, 1987

[54] CLEANING OF METAL ARTICLES

[75] Inventors: James E. Restall, Camberley; Cecil Hayman, Rickmansworth, both of England

[73] Assignee: The Secretary of State for Defense in Her Britannic Majesty's Government of the United Kingdom of Great Britain and Northern Ireland, London, England

[21] Appl. No.: 885,442

[22] Filed: Aug. 29, 1986

[30] Foreign Application Priority Data

Jul. 2, 1986 [GB] United Kingdom ..... 8517766

[51] Int. Cl.[4] ..... B44C 1/22; C23F 1/00; C05C 15/00; C05C 25/06

[52] U.S. Cl. ..... 156/646; 134/2; 134/21; 134/30; 134/34; 134/102; 156/626; 156/651; 156/664; 156/667; 156/345

[58] Field of Search ..... 134/2, 17, 19, 21, 22.12, 134/22.18, 22.19, 30, 34, 102; 156/626, 646, 651, 664, 667, 345

[56] References Cited

U.S. PATENT DOCUMENTS

| | | | |
|---|---|---|---|
| 3,205,105 | 9/1965 | Oster | 156/646 |
| 4,159,917 | 7/1979 | Gluck | 134/3 X |
| 4,551,434 | 11/1985 | Thoma | 156/626 X |
| 4,605,479 | 8/1986 | Faith | 156/646 X |

*Primary Examiner*—William A. Powell

*Attorney, Agent, or Firm*—Nixon & Vanderhye

[57] ABSTRACT

A halide based process for the removal of surface oxidation and corrosion contamination from metallic articles especially cracked superalloy turbine components, which utilizes a pulsed pressure cycle. Preferably the cycle is established by alternate evacuation and replenishment. A cycle operating at 150 torr or less and utilizing $CHF_3$ hydrogen and inert gas as atmosphere is described. The evacuation phase of each cycle should preferably reach 20 torr or less. The process is also applicable to etching for detection of near-surface flaws.

27 Claims, 6 Drawing Figures

CLEANING OF METAL ARTICLES

The present invention relates to the cleaning of metal articles for the removal of surface oxidation and other corrosion contamination. It is especially but not solely of application to the cleaning of iron, nickel or cobalt based superalloy gas turbine engine components. The invention also relates to etch treatment of iron, nickel or cobalt based superalloy articles in manufacture for the detection of flaws therein.

BACKGROUND OF THE INVENTION

The ability to repair rather than replace gas turbine engine aerofoil components such as turbine blades and vanes which become damaged in use is an important factor in reducing engine operating costs for the cost of new components is very high. Such components are routinely found to have incurred damage eg by cracking or severe corrosion, to a degree which requires repair and is indeed repairable providing that surface contamination can be removed. Blades and vanes from the hot section of the engine are particularly prone to oxide and corrosion contamination because these components experience more arduous conditions than others. This contamination is especially difficult to remove from cracks and other tight spots.

Many processes have been used over the years to remove surface contamination from engine run components in order to provide a clean surface which is necessary for brazing or welding repair. For earlier turbine component alloys techniques utilising abrasive blasting, wet processing or reduction at high temperature by hydrogen have proved adequate. However new alloys have been developed to accommodate more arduous operating conditions and such of these alloys as contain for example aluminium, titanium, niobium, hafnium or yttrium are not susceptable to cleaning by the above mentioned techniques because the surface contamination is more tenacious and stable. An alternative technique for these newer alloys utilises fluoride-based reactants.

Keller et al in U.S. Pat. No. 4,098,450 describes a fluoride-based cleaning process using a gaseous reactant produced from a fluoride powder subjected to a high temperature hydrogen atmosphere in a retort. The component to be cleaned is subjected to the action of the reactant at a temperature in the range 870°-1100° C. The resultant reaction converts the metal oxide of the component to fluoride compound which has some degree of volatility and tends to evaporate from the component surface to be carried away by a stream of the reactant gases.

In U.S. Pat. No. 4,188,237 and 4,324,594, Chasteen describes another fluoride-based cleaning process. In this process polytetrafluoroethylene (PTFE) is decomposed at high temperature within a stream of hydrogen and the resultant atmosphere is used to clean components by conversion of metal oxides to fluoride compounds and evaporation of the latter.

Both these prior art fluoride-based cleaning process utilise a continuous flow of reactants. This flow is apparently caused by inlet pressure and from this it is deduced that the process is performed at atmospheric pressure or greater and under steady flow conditions.

The Applicant has found that brazed repairs made to engine run superalloy components and also to artificially damaged superalloy test pieces, made after cleaning thereof by the prior art fluoride-based cleaning process are often insufficiently effective in their pentration of fine surface cracks. This lack of effectiveness is believed to stem from inadequate oxide removal from the interior of the cracks rather than failure of the braze metal to enter such cracks once adequately cleaned.

In order to illustrate the deficiencies of the state of the art cleaning process, reference is made to FIG. 1 of the drawings which shows three micrographs A,B and C, of inadequate braze repairs made to superalloy engine components in consequence of insufficient removal of oxide from the internal surfaces. The specimens shown were cleaned and repaired by a recognised expert source. All specimens shown have been cleaned using a halide based process. The following comments are addressed to the individual micrographs.

Micrograph A

This view at ×100 magnification shows a crack 0.003 in. (~75 μm) wide and 0.016 in. (~400 πm) deep. The repair has only penetrated to 0.008 in (~200 μm) depth due to remaining oxide at the base of the crack. The oxide stringer at the base of the crack is 0.019 in. (~475 μm) long.

Micrograph B

This view at ×100 magnification shows a fine oxidised crack 0.010 in. (~250 μm) deep and 0.001 in. (~25 μm) wide. This crack was typical of twenty others found on this section of engine run component. There are oxide stringers within the layer of surface braze—appearing in cross section as dark blobs. Neither the surface stringers nor the oxidised cracks have been brazed adequately.

Micrograph C

This view at ×50 magnification shows a through-crack in a superalloy section. It will be seen that there is an unacceptable continuous oxide inclusion at the centre of the crack, caused by inadequate cleaning, and that the braze penetration is very poor.

All three of the micrographs shown concern work from one particular trade source so they presumably are the result of one particular cleaning process. However the Applicant's experience through extensive contact with the trade indicates that the micrographs shown are representative of the state of the art processes at least insofar as those processes are applied in the workshop rather than the laboratory. It is considered that established processes are significantly ineffective in cleaning cracks having access dimensions of less than 50 μm.

Fine surface cracks, which are believed to be beyond the limits of efficacy of the prior art cleaning processes, are routinely found at the first stage overhaul of engine-run superalloy components. Consequently the Applicant believes there is a real need to extend the limits of efficacy of superalloy cleaning processes in order to avoid the permitted life of cleaned and repaired components being predicated upon an assumption that unrepaired cracks are present.

It is believed that complete removal of all oxide contamination is not absolutely essential for the success of a subsequent braze repair. However to be effective the cleaning process must break up the oxide contamination sufficiently so that only small islands of oxide remains in order that the braze material might wet the underlying metal and incorporate the remaining oxide. It is most important that the cleaning process penetrates crack interstices to the greatest possible extent in order that wetting and capilliary action can draw the braze material into the crack.

It is known in the metal coating art that a pulsed gas flow can be used to provide an enhanced ability to deposit coatings from the vapour phase within cracks and passages. A process using a pulsed thermally decomposable gas is described in GB Pat. No. 1070396. In GB Pat. No. 1549845 Restall et al describe a process for surface coating turbine components by chemical vapour deposition, which utilises cyclic variations of pressure in the reaction chamber to avoid stagnation of the reactants and reaction products. This process has special benefit for coating designed-in cooling passages and channels within such components, but a typical minimum access dimension for such passages would be 0.01 in (≈250 μm) so the problems of access faced in coating processes are much less severe than those faced in cleaning processes which need to be able to be effective with cracks having access dimensions of less than 0.002 in (≈50 μm).

BRIEF DESCRIPTION OF THE DRAWINGS

In order that the invention and its contribution to the art might be compared with prior practices and fully appreciated, reference is now made to the attached drawings in which.

DETAILED DESCRIPTION OF THE INVENTION

Figure 1A:
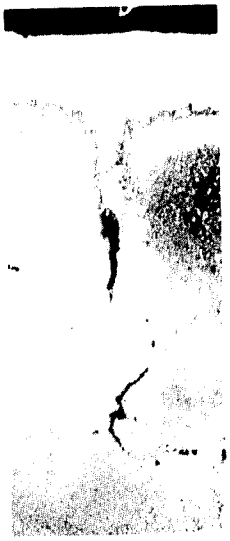
Fig. 1A PRIOR ART
FIG. 1 (prior art, not according to this invention) shows micrographs of inadequate braze repairs made to superalloy engine components in consequence of insufficient removal of oxide from the internal surfaces and illustrates the deficiencies of the state of the art cleaning process.
Figure 1B:
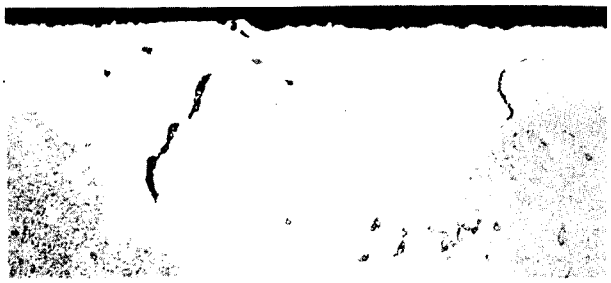
Fig. 1B PRIOR ART
Figure 1C:
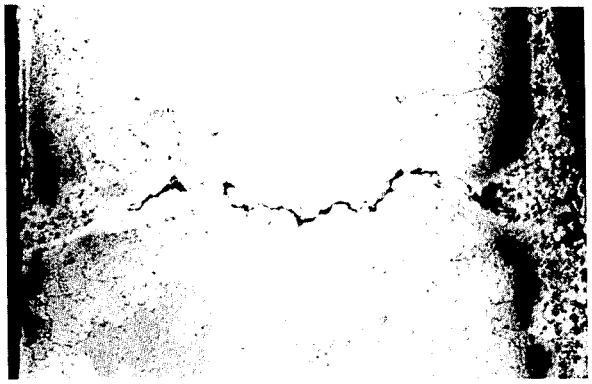
Fig. 1C PRIOR ART

The invention as claimed is intended to provide a halide cleaning process which is able to remove surface oxidation and corrosion contamination from such cracks and other inaccessible places beyond the limits of prior art processes.

The present invention is a cleaning process for removal of surface oxide and corrosion contamination from metallic articles especially those articles which contain passages or cracks, which comprises putting at least one metallic article within a reaction vessel, establishing within that reaction vessel a reactive atmosphere containing at least one halide component, raising the temperature of the article and of the reactive atmosphere within the reaction vessel to a degree such that the or each halide component has sufficient activity to react with surface oxide and corrosion contamination on the article and controlling that temperature to maintain the reaction whilst avoiding heat damage to the article, and cyclically varying the pressure of the reactive atmosphere within the reaction chamber so as to cause general movement of the reactive atmosphere in the region of the article and flow of the gaseous reactants into and out of any passages or cracks in the article.

It has now been found that the use of a pulse pressure cycle in a halide-based cleaning process enables thorough cleaning of cracks and like defects in superalloy components having access dimensions well below the limits of efficacy of prior art processes. Moreover it has been found that a pulse pressure halide based cleaning process has utility in the manufacture of new turbine castings for by using the process to clean the components at the as-cast stage the presence of near surface defects such as those which have a small communicating passage with the surface, or those caused by nonmetallic inclusions, can be indicated. Thus nugatory effort devoted to further processing of defective castings can be avoided. In contrast conventional treatment of turbine castings by hot etching or hydrogen cleaning are not fully effective in revealing the aforementioned defects at the as-cast stage and significant wasted effort can be incurred before faults are detected.

The term "halide" is used herein to embrace both inorganic and organic compounds containing a halogen and the text should be interpreted accordingly. The process of the invention can employ the reactive halide-based atmospheres disclosed previously by Keller and by Chasteen. When such atmospheres are utilised the reaction temperatures will be maintained within the ranges previously disclosed for the non-pulsed prior art processes ie 870°-1100° C. for the Keller process and 400°-1200° C. for the Chasteen process.

However the present invention is not confined to the use of the halide based reactants of the above mentioned prior processes, indeed the Applicant's preferred reactant is different. Whilst the presently preferred reactants are fluoride gases it is anticipated that halides other than fluorides, eg chlorides, or mixtures of a fluoride with eg a chloride could have utility for some applications. The halide reactant which is for superalloy cleaning applications the Applicants first choice, is fluoroform gas ($CHF_3$). This gas is readily available commercially in admixture with argon and is very effective. The use of commercially available gases as reactants avoids reliance on 'in-situ' reactions to provide these, as was the case in the above-mentioned prior art processes and this adds appreciably to the convenience and utility of the process.

The reactive atmosphere may be produced from a pack within the reaction vessel as are the reactants in the well known pack aluminising coating process, providing the components for cleaning are separated from any solid source of reactants. In such case, care should be taken to avoid excessive exhaustion of the reactants in the depressurisation cycles by suitable choice of minimum pressure and cycle frequency based on the nature and quantity of reactants in the reaction vessel and on their vapour pressures.

Preferably the reactive atmosphere is introduced into the reaction vessel from an external source. This allows a greater freedom in chosing cycle frequency and pressure differences. Experiments relating to halide cleaning using fluoroform gas with hydrogen as reactants in an isobaric mode (not claimed in this application) have indicated that pressure plays a significant part in deciding the effectiveness of cleaning. In regard to the invention claimed herein it is considered desirable for the pressure at the low pressure stage of the cycle to be no more than 20 torr and desirable also for the whole cycle to be performed at pressures considerably less than atmospheric pressure say no more than 150 torr. A preferred cycle incorporates a 3-5 torr lower pressure stage and a 50-100 torr upper pressure stage. Preferably also, the cycle includes a dwell phase at both minimum and maximum pressures, the former enables good evacuation of gases from tight passages whilst the latter enables the gases to be reintroduced to tight passageways and gives time for the diffusion and the reaction to take place therein. A preferred cycle consists of 18 seconds at high pressure, 15 seconds at low pressure, 5 seconds evacuation, 2 seconds fill/refill. Obviously the cycle control parameters for any given system can be based on time intervals, gas flows and pressures or a combination of these. When the reactive atmosphere is introduced into the reaction vessel from a remote source, the atmosphere preferably includes a diluent which is inert, such as argon, or is reducing, such as hydrogen, or is a combination of inert and reducing gases. The term "reactive atmosphere" as used herein is used in relation to atmospheres containing reactive components and should not be so construed as to imply that the atmosphere comprises solely components which are reactive. For cleaning superalloy articles, the Applicants' most preferred atmosphere comprises fluoroform gas/inert gas mixture together with hydrogen. To provide such an atmosphere hydrogen and an argon/10% fluoroform mixture are used admixed in various ratios.

Preferably the gases drawn from the reaction vessel in the evacuation phase of the cycle are not reintroduced on repressurisation to avoid reintroducing spent reactants. However it might not be necessary to introduce fresh gases with each repressurisation if the old gases are not fully spent. Alternatives to complete replacement of evacuated gases at each cycle include mixing used and fresh gases on repressurisation, or repressurising with old gases along for a sequence of cycles followed by complete replacement. Such alternative systems would only be attractive if the cost of reactants or difficulties of disposal/recycling outweighed the necessary increases in process control complexity.

One preferred embodiment of the invention comprises putting at least one metallic article within a reaction vessel, evacuating the reaction vessel and backfilling the reaction vessel with inert gas, heating the reaction vessel, introducing into the reaction vessel a reactive atmosphere containing at least one halide component, thereafter successively evacuating the reaction vessel of the gases therein and refilling the reaction vessel with a fresh reactive atmosphere to establish a cyclic variation of the pressure within the reaction chamber between a predetermined upper pressure of 150 torr or less and a predetermined lower pressure. This fill/evacuate/refill cycle is much more readily amenable to pulse pressure operation than would a continuous flow process of the kind used hitherto in the halide cleaning art.

It should be borne in mind that the gases withdrawn from the reaction vessel are likely to be toxic to some degree and should not be discharged to atmosphere but subjected to recognised waste disposal procedures.

The temperature at which the cleaning process of the invention can be performed depends upon the reactants used and also upon the material to be cleaned. The temperature must be sufficiently elevated to induce a degree of thermodynamic activity in the reactants to enable the reaction with the oxide and corrosion contamination to proceed at useful rate. The higher temperature limit is imposed primarily by the need to avoid direct heat-damage to the metallic article but is also dictated to a greater or lesser extent by the need to avoid chemical damage (e.g. intergranular damage) to the article and by economics. For a nickel or cobalt based superalloy, and using the preferred $CHF_3$, hydrogen, argon atmosphere a reaction temperature within the range 900°-1100° C. is preferred.

The process of the invention may include also a vacuum heat treatment stage after completion of the main part of the cleaning to ensure complete removal of residual reactant gas and oxyhalides from the cleaned component before subsequent braze treatment. The Applicant has successfully used a treatment of one hour at 1190° C. in an atmosphere of less than $1\times10^{-4}$ torr, followed by cooling in like vacuum, for this purpose.

It is anticipated that the processes of the invention could be utilised in respect of superalloy or other metal components, both to clean them and to deposit upon them a metal such as chromium for diffusion into the component to replace any material lost in service use or leached out by the cleaning reaction. This could be achieved by the creation of a fluoride metal chemical transport mechanism (as used in prior art turbine blade coating technology) within the reactive atmosphere in the reaction vessel. To establish such transport for chromium, by way of example, chromium fluoride powder either alone, or in admixture with chromium metal powder or a mixture of chromium and nickel powders, could be placed in the reaction vessel out of contact with the component. Chromium fluoride has sufficient vapour pressure at the temperatures used in the cleaning process, to evaporate and establish a transport mechanism. Alternatively chromium powder without chromium fluoride could be included in the reaction vessel, the action of a suitable cleaning gas such as fluoroform causing chromium fluoride to be formed from the chromium powder.

Figure 2:
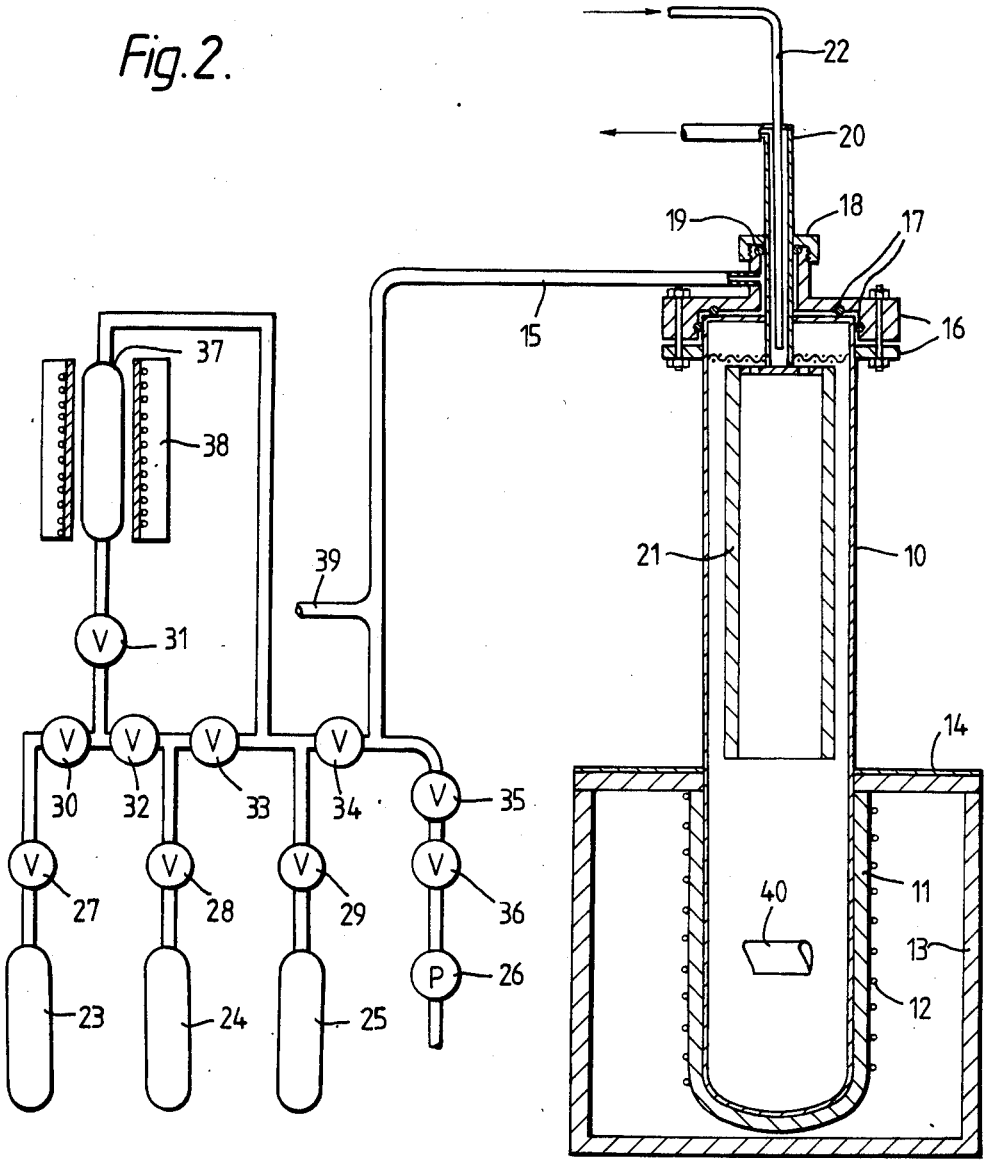
FIG. 2 shows a schematic representation of an illustrative process apparatus of this invention.
Figure 3A:
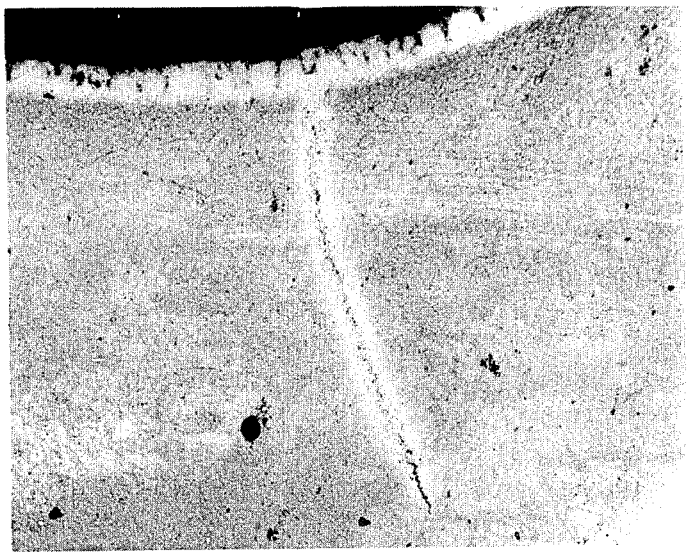
FIG. 3 shows micrographs of brazed-repairs made to supperalloy components following a cleaning treatment in accordance with the invention.
Figure 3B:
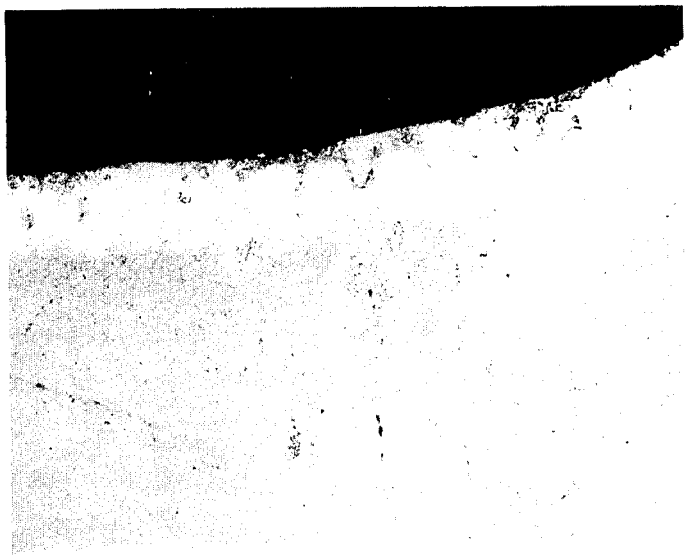

In order to illustrate the invention FIGS. 2 and 3 are described in more detail.

The apparatus shown in FIG. 2 comprises a reaction vessel in the form of a 15 liter retort 10 made of Nimonic (trade designation) superalloy material. This material is chosen because of its resistance to halide attack at process temperatures and because its nickel base is compatible with the nickel and cobalt base superalloy materials to be cleaned should any metal transfer occur. Iron based material such as stainless steel should not be used as vessel material for nickel or cobalt based superalloy cleaning applications because transferred metal would cause undesirable surface contamination of the superalloy. At the lower end of the retort 10, it is enclosed within an alumina tube 11 around which is located a heating element 12. The alumina tube 11 and heating element 12 are contained within a thermally insulated furnace box 13 having a nickel foil heat shield 14 on its upper surface. At its upper end the retort 10 is connected to auxiliary gas supply equipment by a pipe 15. The pipe 15 is connected to the retort 10 by an end plate and flange assembly 16 which includes 'O ' ring seals 17. On top of the end plate is a screw cap 18 having an 'O ' ring seal 19. Passing through and sealed to the cap 18 is a tube 20 which at its lower end within the retort 10 is connected to a hollow cylindrical condensing member 21. A further tube 22 is concentric with the tube 20. Tubes 20 and 22 carry cooling water to cool the condensing member 21. The condensing member 21 serves to condense out of the reactive atmosphere within the retort 10, those metal fluorides resulting from the action of the cleaning gas upon the component to be cleaned. This avoids condensation which might otherwise occur within other parts of the apparatus. The condensing member 21 also serves to cool the upper part of the retort 10.

The auxiliary gas supply equipment shown is of an experimental form enabling the supply of various alternative reaction atmospheres for comparative studies. The equipment shown incorporates cylinders 23, 24 and 25 containing respectively: argon-10% fluoroform, hydrogen, and argon. Various valves are shown at 27 through 36. Valves 27, 28 and 29 are used for flow rate control for cylinders 23, 24 and 25 respectively. Valves 30 through 33 are used for isolation purposes to enable the selection of alternative gases or mixtures of gases. Valves 34 and 35 are power operated time control valves. Another isolation valve 36 leads to a vacuum pump 26—use of which will be explained later. The apparatus also includes a reaction vessel 37 located within a furnace 38. This vessel 37 is provided to enable use of reactants based on fluorocarbon polymer powder decomposition products. In use the polymer powder is located within the vesel 37 which is heated by the furnace 38 to a suitable temperature and hydrogen gas may be directed over the powder from the supply in cylinder 24. Valve 31 enables the reaction vessel limb of the auxiliary equipment to be isolated. A pipe 39 branches from the pipe 15 and leads to a pressure gauge (not shown) used for measurement of the gas pressure in the retort 10.

In use, the apparatus shown in FIG. 2 is operated in the manner of the invention as explained below. An article to be cleaned (represented at 40) is placed within the retort 10 upon a suitable support (not shown). The retort 10 is then sealed by securing the flange 16 and compressing the seals 17. After sealing the retort 10 is evacuated by means of the vacuum pump 26 and back filled with argon drawn from cylinder 25. Once an argon atmosphere has been established within the retort 10, the interior may be heated to the desired reaction temperature, by means of the heating element 12 without causing oxidation of the component 40. A selected reactive atmosphere is then introduced into the retort 10 through the power-operated valve 34 for a predetermined time. The introduced atmosphere is held in the retort 10 by closing valve 34, then withdrawn by opening valve 35 and operating the vacuum pump 26. This cycle of filling, holding, evacuation, holding and refilling is repeated to a predetermined pattern by automatic operation of valves 34 and 35 together with vacuum pump 26 for the duration of the cleaning process. The process conditions are predetermined by metering the gas flow rates to determine admixture ratios and by measuring the chamber pressures consequent upon predetermined cycle times and flow rates. In use the process conditions are held to sufficient degree of accuracy by timed operation of valves 34 and 35 and the vacuum pump 26. On completion of the cleaning process, the retort is evacuated of the reactive atmosphere and back-filled with argon before removal of the cleaned component 40.

The process of the invention is further documented below by reference to several illustrative examples concerning cycle parameters, gaseous reactants, materials cleaned, and results achieved.

EXAMPLE 1

A test piece of a superalloy having the trade designation AP1 (composition in weight per cent: 0.03 C; 15.0 Cr; 3.5 Ti; 4.0 Al; 17.0 Co; 5.0 Mo; 0.04 Zr; 0.025 B balance Ni) was mechanically fatigued under controlled conditions to produce a crack therein. The crack dimensions were ascertained to the degree of accuracy possible by external scanning electron microscopy. The dimensions were ascertained to be as follows: 1620 μm deep, 18 μm across at surface, 10 μm across at 800 μm depth narrowing to a sharp point at full depth. The specimen thus cracked and measured was then articially oxidised to produce a degredation representative of service degradation to approximately 20 μm depth on the external surfaces. The article was then peened to remove as much of the surface oxide as possible by mechanical action leaving an unaffected layer 2–3 μm thick within the crack. The test article was then placed in the reaction vessel which was evacuated and back-filled with argon before heating to the process temperature which was 950° C. Hydrogen was drawn from cylinder 24 and passed through the reactor 37 containing an excess of polytetrafluorethylene (PTFE) powder and heated to a temperature of 450° C. Gases drawn from the reactor, comprising hydrogen and the reduction products of PTFE provided the reactive atmosphere used in this experiement. The pressure cycle had the following parameters: cycle duration −40s; filling phase −2s; upper pressure pause 18s; evacuation phase −5s; lower pressure pause −15s; upper pressure 50 torr; lower pressure 5 torr. The treatment time was 5h and on completion of the treatment the reaction vessel was evacuated, back-filled with argon and cooled to enable removal of the test article. The article which was bright and shiny at the surface was subsequently sectioned through the crack and analysed for oxide along the crack surface using electron microprobe analysis. The surface was found to be substantially free of continuous oxide contamination to the root of the crack and consequently the component is in a very satisfactory state for a braze repair.

EXAMPLE 2

Test pieces of AP1 superalloy were fatigued and oxidised using the procedure described in Example 1. Further test pieces of another commercially superalloy C1023 (which has the composition by weight of: 0.16 C; 15.5 Cr; 3.6 Ti; 4.2 Al; 10.0 Co; 8.5 Mo; 0.006 B balance NI) were subjected to surface welding to cause the material to crack controllably—the material being one which is unsuitable for welding. These weld cracked test pieces were then oxidised in like manner to the AP1 test pieces. Other C1023 articles comprised engine-run nozzle guide vanes.

Samples of all three types of article described above; ie the engine run C1023 components together with the AP1 and C1023 test pieces were subjected to the cleaning process of the invention. They were first peened as described in Example 1 to remove surface oxide and then cleaned using a mixture of fluoroform gas and hydrogen. The following process parameters were utilised.

Regime 'A'

Gases: argon/10% fluroform mix and hydrogen mixed 1 part by volume of fluroform to 10 parts by volume of hydrogen.

Pressure cycle: duration −40s; filling phase −2s; upper pressure pause −18s; evacuation phase −5s; lower pressure pause −15s.

Upper pressure—50 torr
Lower pressure—5 torr
Process duration 3h

Process temperature 950° C.

Regime 'B'

As Regime A save as follows below:

Gases: mixed in ratio 1 part by volume of fluroform to 5 parts by volume of hydrogen.

Pressure cycle: duration 80s all phases twice duration given for Regime A.

Upper pressure: 100 torr

Lower pressure: 3 torr

Both process regimes produced very satisfactory results being extremely efficient in removing both surface and crack contamination from the articles cleaned, to a level very acceptable for braze repairing.

EXAMPLE 3

A test piece of AP1 alloy was fatigue-cracked, oxidised and peened as described in Example 1. It was then cleaned using the Regime A conditions described in Example 2. The cleaned test piece was then removed to a vacuum brazing chamber in which it was vacuum cleaned to remove any residual trace of the cleaning reactant gases by heating to 1190° C. under a vacuum of better than $10^{-4}$ torr and kept thus for 1h. The test piece was then brazed using a conventional vacuum brazing technique by placing a foil of braze material around the test piece and heating both under vacuum. The braze material had the following composition in weight per cent: 19 Cr; 10 Si; 0.1 C max; balance Ni. The repaired test piece was then sectioned along the site of the former crack, mounted, polished then etched using a 2 percent solution of HF in water to reveal the microstructure. FIG. 3 shows optical micrographs of this repaired AP1 specifment at ×60 and ×120 magnifications. It will be seen that the braze repair has penetrated to the root of the crack, that the braze has wetted the substrate surface and fused therewith, and that the interface is free of oxide contamination. The segregated structure of the surface braze layer is the normal structure of the eutectic braze material. The crack length measured from the ×60 view is some 1300 μm.

The invention has been illustrated by reference to examples concerning its principal application that of cleaning superalloy components for repair purposes. However the invention is not limited to such an application. The quality control aspect of the invention is extremely important. Moreover it is considered that the invention could be utilised in the repair of heat resistant steels and the repair of flaws in expensive castings.

We claim:

1. A cleaning process for removal of surface oxide and corrosion contamination from metallic articles especially those articles which contain passages or cracks, which comprises putting at least one metallic article within a reaction vessel, establishing within that reaction vessel a reactive atmosphere containing at least one halide component, raising the temperature of the article and of the reactive atmosphere within the reaction vessel to a degree such that the or each halide component has sufficient activity to react with surface oxide and corrosion contamination on the article and controlling that temperature to maintain the reaction whilst avoiding heat damage to the article, and cyclically varying the pressure of the reactive atmosphere within the reaction chamber so as to cause general movement of the reactive atmosphere in the region of the article and flow of the gaseous reactants into and out of any passages or cracks in the article.

2. A cleaning process as claimed in claim 1 wherein the pressure of the reactive atmosphere within the reaction vessel is cyclically varied between an upper pressure and a lower pressure and the upper pressure is held at or below a maximum of 150 torr.

3. Use of the process as claimed in claim 2 in etching metallic articles to highlight for visual detection near-surface flows therein.

4. A cleaning process as claimed in claim 2 wherein said lower pressure is not more than 20 torr.

5. A cleaning process as claimed in claim 4 in which the upper pressure is in the range 50–100 torr and the lower pressure in the range 3–5 torr.

6. A cleaning process as claimed in claim 4 wherein the pressure of the reactive atmosphere within the reaction vessel is held for a first predetermined interval at the upper pressure stage of the cycle and is held for a second predetermined interval at the lower pressure stage of the cycle.

7. A cleaning process as claimed in claim 6 in which said first interval and said second interval are both of at least 10s duration.

8. A cleaning process as claimed in claim 1 wherein a halide component of the reactive atmosphere is $CHF_3$.

9. A cleaning process as claimed in claim 2 wherein a halide component of the reactive atmosphere is $CHF_3$.

10. A cleaning process as claimed in claim 9 wherein the reactive atmosphere includes hydrogen.

11. A cleaning process as claimed in claim 10 wherein the reactive atmosphere consists essentially of $CHF_3$, hydrogen and an inert gas.

12. A cleaning process as claimed in claim 11 wherein the $CHF_3$ and hydrogen components of the reactive atmosphere are present in a ratio by volume of between 1:20 and 1:3.

13. A cleaning process as claimed in claim 11 in which the reaction temperature is within the range 700°–1100° C.

14. A cleaning process as claimed in claim 1 in which the reactive atmosphere is produced by heating a fluoropolymer under hydrogen and comprises the product of such reaction.

15. A cleaning process as claimed in claim 2 in which the reactive atmosphere is produced by heating a fluoropolymer under hydrogen and comprises the product of such reaction.

16. A cleaning process as claimed in claim 15 in which temperature within said reaction vessel is maintained within the range 400°–1200° C.

17. A cleaning process as claimed in claim 1 wherein the reactive atmosphere incorporates a fluoride component and a non fluoride halide component.

18. A cleaning process for the removal of surface oxide and corrosion contamination from metallic articles especially those which contain passages or cracks, which comprises putting at least one metallic article within a reaction vessel, evacuating the reaction vessel and backfilling the reaction vessel with inert gas, heating the reaction vessel, introducing into the reaction vessel a reactive atmosphere containing at least one halide component, thereafter successively evacuating the reaction vessel of the gases therein and refilling the reaction vessel with a fresh reactive atmosphere to establish a cyclic variation of the pressure within the reaction chamber between a predetermined upper pressure and predetermined lower pressure, and maintaining the temperature of the article and of the reactive atmosphere to a degree such that the or each halide has sufficient activity to react with surface oxide and corrosion contamination on the article whilst avoiding heat damage thereto; whereby said cyclic variation of the pressure within the reaction chamber causes general movement of the reactive atmosphere in the region of the article and flow of the gaseous reactants into and out of any passages or cracks in the article and whereby the pressure within the reaction vessel during said cyclic variation is held within a maximum of 150 torr.

19. A cleaning process as claimed in claim 18 in which a halide component of the reactive atmosphere is $CHF_3$.

20. A cleaning process as claimed in claim 18 in which the reactive atmosphere includes hydrogen.

21. A cleaning process as claimed in claim 20 in which the reactive atmosphere consists essentially of $CHF_3$, hydrogen and an inert gas.

22. Use of the process as claimed in claim 17 in etching metallic articles to highlight for visual detection near-surface flaws therein.

23. Use of the process as claimed in claim 20 in etching metallic articles to highlight for visual detection near-surface flaws therein.

24. A cleaning process as claimed in claim 21 in which the replenishment part of each cycle is of approximately 2s duration the evacuation part of each cycle is of approximately 5s duration with approximately 18s hold at upper pressure and approximately 15s hold at lower pressure.

25. A cleaning process as claimed in claim 18 when used for the cleaning of a material selected from the group consisting of nickel and cobalt based superalloys and in which the temperature of the article and reactive atmosphere is maintained within the range 900°–1100° C.

26. A cleaning process as claimed in claim 18 comprising the additional step of evacuating the reaction vessel at cessation of the pulsed cycle step and maintaining the article therein at an elevated temperature to remove residual reactants therefrom.

27. A cleaning process as claimed in claim 25 comprising the additional step of evacuating the reaction vessel at cessation of the pulsed cycle step and maintaining the article therein at an elevated temperature within the range 1100°–1200° C. to remove residual reactants therefrom and to cause solution treatment to the superalloy article for recovery of mechanical properties.

* * * * *